US011654711B2

(12) United States Patent
Ikai et al.

(10) Patent No.: US 11,654,711 B2
(45) Date of Patent: May 23, 2023

(54) WRITING TOOL PROVIDED WITH REFILL

(71) Applicant: MITSUBISHI PENCIL COMPANY, LIMITED, Shinagawa-ku (JP)

(72) Inventors: Takayuki Ikai, Shinagawa-ku (JP); Seiichi Maruyama, Shinagawa-ku (JP); Kiyoshi Iwamoto, Shinagawa-ku (JP)

(73) Assignee: MITSUBISHI PENCIL COMPANY, LIMITED, Shinagawa-ku (JP)

( * ) Notice: Subject to any disclaimer, the term of this patent is extended or adjusted under 35 U.S.C. 154(b) by 158 days.

(21) Appl. No.: 17/268,828

(22) PCT Filed: Jun. 17, 2019

(86) PCT No.: PCT/JP2019/023860
§ 371 (c)(1),
(2) Date: Feb. 16, 2021

(87) PCT Pub. No.: WO2020/044737
PCT Pub. Date: Mar. 5, 2020

(65) Prior Publication Data

US 2021/0178803 A1 Jun. 17, 2021

(30) Foreign Application Priority Data

Aug. 29, 2018 (JP) ..... JP2018-159880

(51) Int. Cl.
*B43K 7/08* (2006.01)
*B43K 7/12* (2006.01)
*B43K 24/12* (2006.01)

(52) U.S. Cl.
CPC ..... *B43K 7/08* (2013.01); *B43K 7/12* (2013.01); *B43K 24/12* (2013.01)

(58) Field of Classification Search
CPC ... B43K 1/08; B43K 7/02; B43K 7/04; B43K 7/06; B43K 7/08; B43K 8/03; B43K 24/10
See application file for complete search history.

(56) References Cited

U.S. PATENT DOCUMENTS 5,401,257 A * 3/1995 Chevalier, Jr. .... A61M 25/0017 604/93.01
5,888,009 A * 3/1999 Toyama ..... B43M 11/085 401/214

(Continued)

FOREIGN PATENT DOCUMENTS

CN 1131098 A 9/1996
JP 60-58388 U 4/1985

(Continued)

OTHER PUBLICATIONS

International Search Report dated Sep. 10, 2019 in PCT/JP2019/023860 filed Jun 17, 2019, 2 pages.

(Continued)

*Primary Examiner* — David P Angwin
*Assistant Examiner* — Bradley S Oliver
(74) *Attorney, Agent, or Firm* — Oblon, McClelland, Maier & Neustadt, L.L.P.

(57) ABSTRACT

A writing tool includes a refill having an ink reservoir tube formed to be a straight cylinder whose wall thickness is less than 0.56 mm; and a writing tip or a relay member holding the writing tip attached to a first end of the ink reservoir tube, wherein the refill is detachably attached to a barrel, wherein in the refill, amounting strength between the writing tip or the relay member holding the writing tip and the ink reservoir tube is set higher than a mounting strength between the barrel and a connecting portion of the ink reservoir tube. There is provided a writing tool that can prevent the occur- (Continued)

rence of a problem such as leakage of ink at a time of replacement of refills and perform replacement of refills smoothly.

1 Claim, 16 Drawing Sheets

(56) References Cited

U.S. PATENT DOCUMENTS

| | | | | | |
|---|---|---|---|---|---|
| 5,899,618 | A | * | 5/1999 | Kobayashi | B43K 24/146 401/29 |
| 6,076,987 | A | * | 6/2000 | Sekine | B43K 1/08 401/209 |
| 6,217,241 | B1 | | 4/2001 | Kobayashi | |
| 7,600,938 | B2 | * | 10/2009 | Kobayashi | C09D 10/00 401/214 |
| 7,946,777 | B2 | * | 5/2011 | Yamauchi | B43K 27/12 401/31 |
| 2003/0215279 | A1 | | 11/2003 | Katami | |
| 2006/0075924 | A1 | | 4/2006 | Kobayashi et al. | |

FOREIGN PATENT DOCUMENTS

| | | | | |
|---|---|---|---|---|
| JP | 6-200235 | A | | 7/1994 |
| JP | 2000-198291 | A | | 7/2000 |
| JP | 2002-59682 | A | | 2/2002 |
| JP | 2002059682 | A | * | 2/2002 |
| JP | 2003-335093 | A | | 11/2003 |
| JP | 2004-314317 | A | | 11/2004 |
| JP | 2010-155426 | | | 7/2010 |
| JP | 2016-64609 | A | | 4/2016 |
| JP | 2016-101703 | A | | 6/2016 |
| JP | 2016101703 | A | * | 6/2016 |
| JP | WO 2017/061570 | A1 | | 4/2017 |
| JP | 2017-87457 | A | | 5/2017 |

OTHER PUBLICATIONS

Combined Chinese Office Action and Search Report dated Dec. 20, 2022 in Chinese Patent Application No. 201980056811.4, 8 pages.

* cited by examiner

WRITING TOOL PROVIDED WITH REFILL

BACKGROUND OF THE INVENTION

Field of the Invention

The present invention relates to a writing tool having a detachably mounted writing refill filled with an ink having a writing tip on a tip end.

Description of the Related Art

A refill to be used for a writing tool such as a ballpoint pen has an ink reservoir tube and to one end (front end) of which typically a ballpoint pen tip as a writing part or a relay member holding a ballpoint pen tip is press-fitted.

The ink reservoir tube is made of a transparent or semi-transparent resin material such as polypropylene is used in order to achieve easiness of molding and visibility of the stored ink.

As disclosed in paragraph [0021] of Patent Literature 1, for example, a typical ink reservoir tube made of a resin material such as polypropylene having an outer diameter of approximately 3.0 mm and an inner diameter of approximately 1.8 mm is often used.

In the case of the ink reservoir tube according to the example above, an ink amount that can be stored in the ink reservoir tube is limited due to the relatively small outer diameter and the thick wall thickness. This causes a practical difficulty that a sufficient writing distance is not obtainable.

An ink reservoir tube of the refill for writing tool, which has nearly the same outer diameter as a conventional one and a thinner wall thickness of ink reservoir portion by expanding the inner diameter, is proposed by the present inventor and disclosed in Patent Literature 2 and Patent Literature 3.

LIST OF CITED DOCUMENTS

Patent Literature

Patent Literature 1: JP-A-2000-198291
Patent Literature 2: JPWO-2017-61570
Patent Literature 3: JP-A-2017-87457

For writing tools provided with this kind of refill, there are some occasions of operation that a refill is pulled out from the barrel by pinching the writing tip at the tip end of the refill is performed when the refill housed in a barrel is replaced.

For writing tools provided with a thin-walled refill, when the refill is pulled out from the barrel by pinching the writing tip at the tip end of the refill, a writing tip or a relay member holding a writing tip may come off not from the barrel but the ink reservoir tube; therefore, this may cause an unfavorable phenomenon such as scattering of the ink stored in the ink reservoir tube.

SUMMARY OP THE INVENTION

The present invention is made based on the assumption of occurring of unfavorable phenomena. The main objective is to provide a writing tool provided with a refill capable of surely detaching the refill from the writing tool and avoiding the unfavorable phenomena that a writing tip or a relay member holding a writing tip may come off not from the barrel but the ink reservoir tube.

The present invention is related to a writing tool provided with a refill detachably mounted in a barrel, and the refill includes an ink reservoir tube shaped in a straight cylinder having a thickness of the ink reservoir tube less than 0.56 mm and a writing tip or a relay member holding a writing tip at one end of the ink reservoir tube, wherein the mounting strength of the refill at a connecting portion between the ink reservoir tube and the writing tip or the relay member holding the writing tip is set higher than that at a connecting portion between the barrel and the ink reservoir tube.

The outer diameter of the connecting portion, where a writing tip or a relay member holding a writing tip is press-fitted to the inner circumference at one end of the ink reservoir tube, is desirably expanded by 0.1 mm or more by press-fitting than the outer diameter at a central portion of the ink reservoir tube along the longitudinal direction.

In a preferred embodiment according to the present invention, a plurality of refills having writing tips at one end each of which has a different ink flow rate per unit distance is housed in a barrel, and the other end of the plurality of refills is detachably mounted in the barrel and has the same outer and inner diameters as each other, where the unit distance is the distance based on the writing test described in the Japanese Industrial Standards, JIS S 6039, JIS S 6054, JIS S 6061, and others.

A configuration is also suitably adopted where a metal tube is mounted along the outer circumference of the ink reservoir tube to a connecting portion at one end of the ink reservoir tube where a writing tip or a relay member holding a writing tip is attached.

Another configuration is also suitably employed where a locking protrusion toward the inner surface of the ink reservoir tube is formed at a connecting portion where a writing tip or a relay member holding a writing tip on one end of the ink reservoir tube is attached, and a locking recess to be locked with the locking protrusion is formed on the writing tip or the relay member holding a writing tip.

Another configuration is also suitably employed where a thickened part toward the inner surface of the ink reservoir tube is formed at a connecting portion where a writing tip or a relay member holding a writing tip on one end of the ink reservoir tube is connected and a reduced inner diameter portion to be connected to the ink reservoir tube by being locked with the thickened part is formed on a writing tip or the relay member holding a writing tip.

Another configuration is also suitably employed where, at a connecting portion where a writing tip or a relay member holding a writing tip on one end of the ink reservoir tube is connected to the ink reservoir tube, an adhesive is applied.

An ink backflow preventing body is provided in the ink reservoir tube and is disposed at a position being in contact with a rear face of the ink in the ink reservoir tube. The ink backflow preventing body goes forward along with consumption of ink while writing. A relation is desirably set such that $X/d^{*}>0.2$, where X (mg) denotes ink consumption per writing distance of 100 m and d (mm) denotes the inner diameter of ink reservoir tube.

A plurality of ink reservoir tubes having a different inner diameter is housed in the barrel and refill advancing operating members with which respective refills are delivered from the barrel are desirably different in color or appearance such as shapes.

When a plurality of ink reservoir tubes having a different inner diameter is housed in the barrel, appearances of the refills are desirably different in such as coloring on the vicinity of the tip end of the respective refills, the shape of resin ball attached at the tip end of the writing tip for preventing vaporization of ink, and color and shape of relay members holding the writing tips.

Further, at a connecting portion where a writing tip or a relay member holding a writing tip on one end of the ink reservoir tube is connected to the ink reservoir tube, a tapered face whose diameter is gradually expanding toward the tip end of a writing tip and a plurality of annular locking portions that sharply reduces the diameter continuously from the tapered face is formed along an axis direction, and the ink reservoir tube is connected to a writing tip or a relay member through the plurality of the annular Locking portion.

As another configuration, at a connecting portion where a writing tip or a relay member holding a writing tip on one end of the ink reservoir tube is connected to the ink reservoir tube, a plurality of protrusions having a tapered face gradually rising toward the tip end of a writing tip and a falling down portion that sharply falls continuously from the tapered face is formed discontinuously along a circumferential and axial direction; the ink reservoir tube is connected with a writing tip or the relay member through the plurality of protrusions.

In addition, another configuration is also suitably employed where a ring-shaped reinforcing member is fitted to an outer circumferential surface of the ink reservoir tube at the connecting portion where the ink reservoir tube and a writing tip of a relay member holding a writing tip are connected.

Further, another configuration is also suitably employed where a reinforcing member having a C-shape cross-section perpendicular to the axis is fitted to an outer circumferential surface of the ink reservoir tube at the connecting portion where the ink reservoir tube and a writing tip or a relay member holding a writing tip are connected.

Another method to achieve a high connection strength between the ink reservoir tube and a writing tip or a relay member holding a writing tip is the adoption of a structure that the ink reservoir tube is connected with a writing tip or a relay member by a garter spring (an annular spring); a cylinder that is formed in a writing tip or a relay member and to which a front end portion of the ink reservoir tube is inserted, the garter spring that is housed in a bottom portion of the cylinder and being pressure-fitted with the front portion of the ink reservoir tube, and a pressing ring that is housed in the cylinder to position the garter spring at the bottom portion of the cylinder are included.

The writing tool according to the present invention achieves that the ink reservoir tube formed in a straight and cylindrical shape can substantially have an enlarged inner diameter of the ink reservoir tube by making the thickness of the ink reservoir portion less than 0.56 mm; therefore, a refill ensuring the desired amount of stored ink can be obtained. The connection strength of the connecting portion of a refill between the ink reservoir tube and a writing tip or a relay member holding a writing tip is set higher than that between the ink reservoir tube and the barrel.

As a result, when the writing tip at the tip end of the refill is pinched and the refill is pulled out from the inside of the barrel when the refill is replaced, the refill can be reliably separated from the barrel. Therefore, it is possible to avoid the problem that the writing chip or the relay member holding the writing chip is detached from the ink reservoir tube and the ink in the ink reservoir tube scatters.

BRIEF DESCRIPTION OF THE DRAWING

FIG. 9A is central cross-sectional view of a seventh embodiment, FIG. 9B is central cross-sectional view of a eighth embodiment, and FIG. 9C is central cross-sectional view of a ninth embodiment.

FIG. 10B is an enlarged vies of a main part.

FIG. 11A is a perspective view of a main part and FIG. 11B is a front view of the main part.

FIG. 12A is a perspective view of a main part and FIG. 12B is a front view of the main part.

FIG. 13A is a perspective view of a reinforced member before mounted, FIG. 13B is a perspective view of a main part, and FIG. 13C is an enlarged perspective view of a main part in a state where the reinforced member is mounted.

FIG. 14A is a perspective view of a reinforced member before mounted. FIG. 14B is a perspective view of a main part, and FIG. 14C is an enlarged perspective view of a main part in a state where the reinforced member is mounted.

FIG. 15A is a front view and FIG. 15B is a central cross-sectional view.

DESCRIPTION OF THE PREFERRED EMBODIMENTS

On a writing tool provided with refills according to the present invention, an embodiment shown in drawings of an example of a composite writing tool mounted with a plurality of refills, three refills in this case, in a barrel will be described.

In each of the following drawings, equivalent parts or parts that have equivalent functions are numbered with the same corresponding signs, and a detailed description thereof is omitted.

Figure 1A:
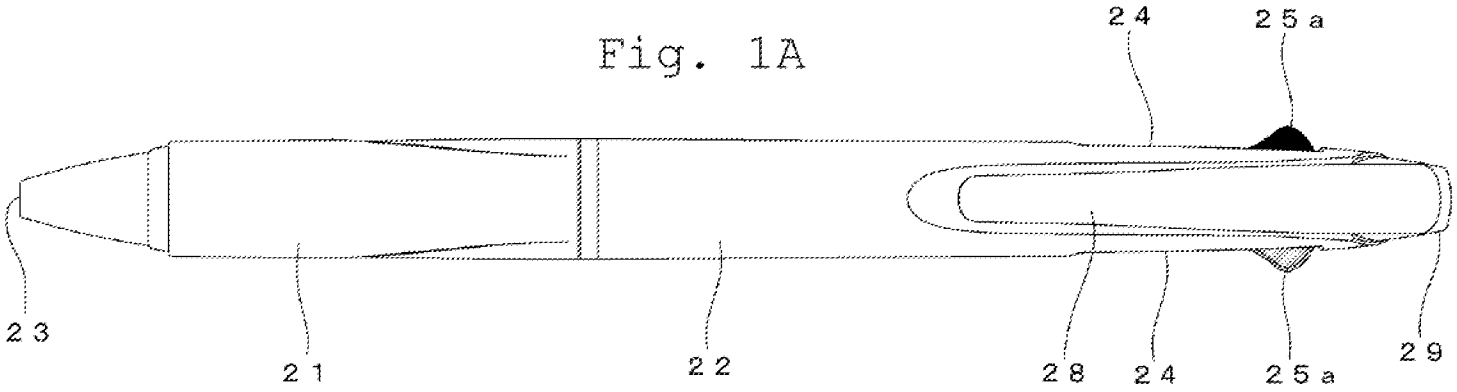
FIG. 1A is a top view with a clip facing up and FIG. 1B is a front view with a 90-degree axis rotation; those shown in an external view of an example in which the present invention is applied to a composite writing tool.
Figure 1B:
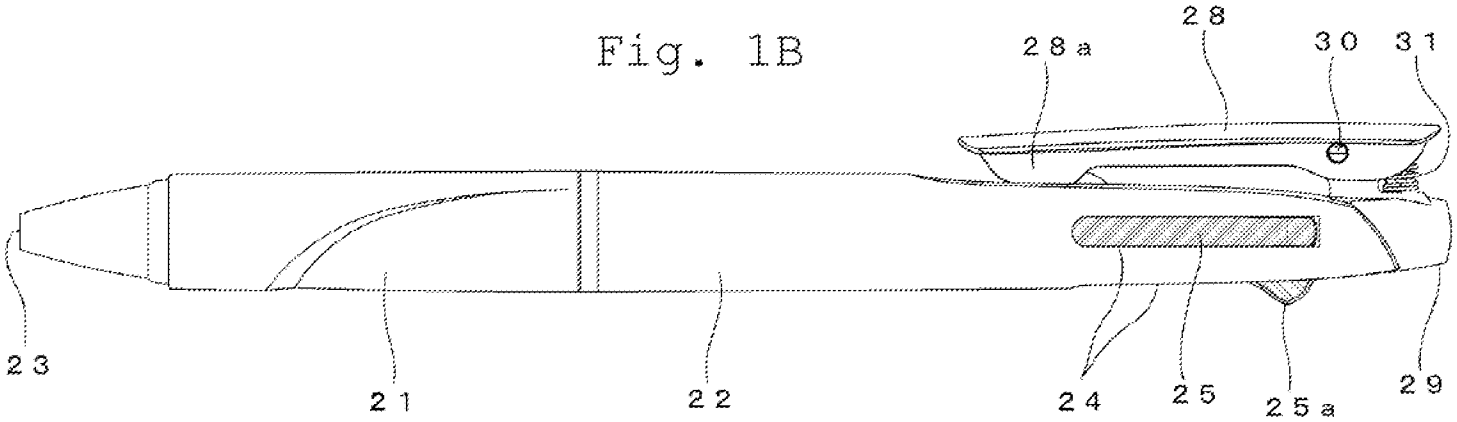
Figure 2:
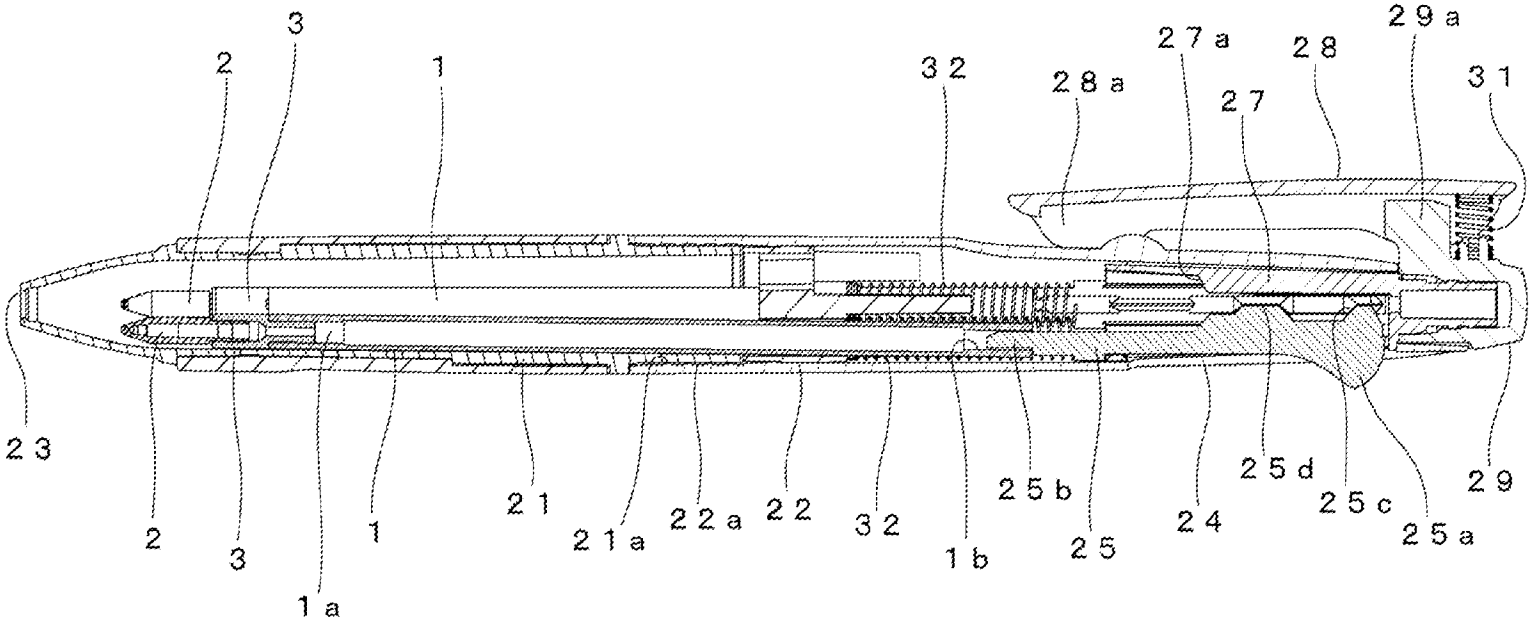
FIG. 2 is a central cross-sectional view of the compound writing tool in FIGS. 1A and 1B.

In a composite writing tool shown in FIGS. 1A, 1B, 2A, and 2B, a front barrel 21 and a rear barrel 22 constitute a barrel, and the front barrel 21 and the rear barrel 22 are detachably connected in an axial direction as shown in FIG. 2 as a cross-sectional view, by screwing a male thread 21*a* formed on a rear outer circumferential surface of the front barrel 21 with a female thread 22*a* formed on an inner circumferential surface of the rear barrel 22.

The front barrel 21 has a tip end opening 23 by conically reducing the diameter, and one of the writing tips (ballpoint pen tips) 2 is selectively delivered from the tip end opening 23.

At a rear end of the rear barrel 22, a plurality of guiding slits 24, three slits, in this case, is formed. On each of the guiding slits 24, a refill advancing operating member 25*a*, protruding from the outer circumferential surface of the rear barrel 22, formed on a slider 25 is slidably disposed along the axial direction.

In the rear barrel 22 in which the guiding slits are formed, an inner cylinder 27 is housed locating inside the guiding slit 24, and in the inner cylinder 27, a locking face 27*a* is formed to lock the slider 25 in an advanced state.

A rear end of the inner cylinder 27 is formed to a small-diameter shape and slightly protrudes from a rear end of the rear barrel 22. A cap 29 to which a clip 28 is attached is fixedly mounted to cover the protruding portion of the inner cylinder 27.

A mounting portion 29*a* for mounting the clip 28 is integrally formed to the cap 29, and the clip 28 is rotatably fixed to the cap 29 with a shaft 30 penetrating the mounting portion 29*a*. A coil spring 31 is mounted between the cap 29 and the clip 28. A ball portion 28*a* formed at a distal end of the clip 28 is lightly pressed to the side of the rear barrel 22 by the biasing force of the coil spring 31.

A refill mounting member 25*b* formed at the front end of the slider 25 is press-fitted into a rear-opening of the ink reservoir tube forming a refill. A return spring is arranged to surround each of the ink reservoir tubes and the sliders 25, and each of the ink reservoir tubes 1 and the sliders 25 is arranged in a state of being biased rearward in the barrel by the biasing force of the spring 32.

In a state of the above arrangement, when the refill advancing operating member 25*a* of any one of the sliders 25, a first slider, is moved forward, the refill advancing operating member 25*a* of the slider 25 falls into the axial direction of the barrel while advancing along a groove formed on the inner portion 27. Accordingly, a rear locking portion 25*c* of the slider 25 is locked with a locking face 27*a* formed on the inner cylinder 27. Then, the refill held by the slider 25 bends slightly due to its flexibility of the refill, and the ballpoint pen tip 2 is maintained in a coming-out state from the front end opening 23.

In this state, when a second slider 25 is moved forward, a lock-releasing cam 25*d* formed on the second slider abuts on the rear locking portion 25*c* of the first slider that is already locked in an advanced state and pushes out the rear locking portion 25*c* of the first slider 25; whereby the locking state of the first slider is released.

As a result, the first slider 25 retracts backward by the action of the return spring 32, and a rear locking portion 25*c* of the second slider 25 is locked with a locking face 27*a* formed on the inner cylinder 27; whereby the exchange of ballpoint pen tip 2 coming-out from the front end opening 23 is completed.

An ink reservoir tube forming a refill for the composite writing tools is favorably made of a resin material, such as polypropylene.

The ink reservoir tube is formed to be straight along an axial direction as shown in FIG. 2 and cylindrical. At the front end and the rear end of the tube, a front connecting portion 1*a* and a rear 1*b* being thickened toward the inner circumferential surface are integrally formed with the ink reservoir tube 1.

A relay member 3 to which a ballpoint pen tip 2 is mounted in advance is attached to one end (front end) of the ink reservoir tube 1 shown in FIG. 2. A ballpoint pen refill to which a ballpoint pen tip 2 is directly mounted at the front end of the ink reservoir tube 1 without employing a relay member 3 is also favorably adopted.

Another configuration is also applicable that the connecting portion 1*b* is formed as a separate part from the ink reservoir tube 1 and is attacked to the rear end of the ink reservoir tube 1.

For this kind of composite writing tool, when a refill is replaced, the refill is detached by pulling the ink reservoir tube 1 that is fixed to the refill mounting portion 25*b* of the slider 25 in a state where the front barrel 21 is detached from the rear barrel 22. In this case, a user often pulls the ink reservoir tube 1 to detach from the slider 25 in the barrel by grasping the ballpoint pen tip at the tip end of the refill.

Therefore, the connecting strength between a writing tip 2 or a relay member 3 holding a writing tip 2 and an ink reservoir tube is desirably set higher than the connecting strength between a slider in the barrel and the ink reservoir tube.

With this structure, a problem of unexpected scattering of ink due to detaching of connection between the writing tip 2 or the relay member 3 holding the writing tip 2 can be avoided; the ink reservoir tube 1 is surely detached from the slider 25 in the barrel when a refill is replaced.

The construction of main parts particularly of the ink reservoir tube 1 of a ballpoint pen refill which is invented to achieve the effects described above will be described.

According to the ballpoint pen refill of the first embodiment, as shown in the above example, since a connecting portion 1*a* and 1*b* are thickened toward the inner circumferential, the sufficient mechanical strength of a connecting portion for a relay member 3 or a writing tip 2 can be secured. The thickness of the ink reservoir tube other than the connecting portions can be relatively thinner; this makes it possible to secure a necessary amount of stored ink without expanding the outer diameter of the ink reservoir tube.

Figure 3:
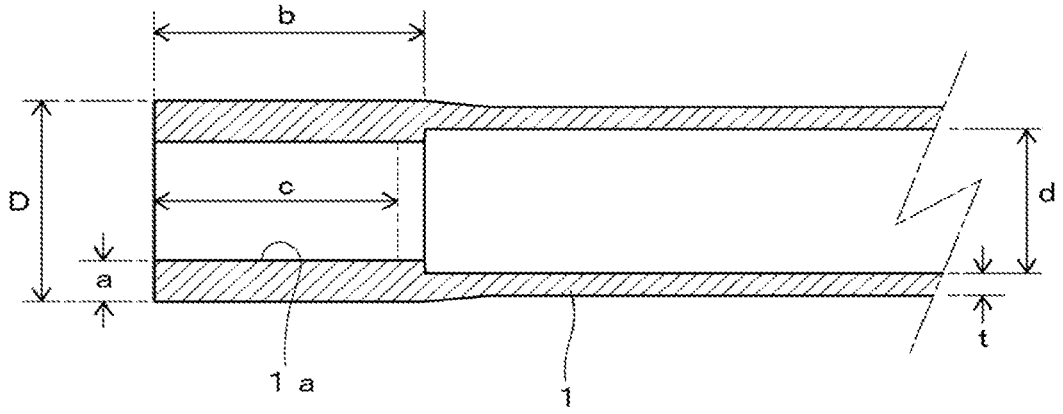
FIG. 3 is an enlarged sectional view of a connecting portion of an ink reservoir tube of a first embodiment of a refill used to a composite writing tool shown in FIGS. 1A, 1B and 2.

FIG. 3 shows the preferable dimensions of each portion and a preferable relation between each portion regarding the connection part 1*b*, to which a writing tip 2 or a relay member 3 is attached, formed at the front end of the ink reservoir tube 1.

The preferable dimensions of each portion and a preferable relation between each portion regarding the connection part 1*b* formed at an rear end of the ink reservoir tube of a ballpoint pen refill are constructed similarly, in ranges as shown below.

D (Outer diameter of the ink reservoir tube):

2.5 mm to 3.6 mm, favorably 2.9 mm to 3.2 mm;

t (Thickness of the ink reservoir tube):

0.25 mm or larger, favorably 0.3 mm to less than 0.56 mm;

a (Thickness of connecting portion):

0.5 mm to 0.7 mm, favorably 0.55 mm to 0.65 mm;

b (Length of connecting portion):

1.0 mm to 6.0 mm, favorably 2.5 mm to 4.5 mm;

c (Contact length at the connecting portion):

1.0 mm to 6.0 mm, favorably 2.5 mm to 4.5 mm;

a×b(D−a); 1 to 12, favorably 3 to 8; if the value is smaller than 1, a sufficient fitting force (mounting strength) 10 N may not be obtained and if the value is 12 or more, the writing tip may not be fitted well because the press-fitting force necessary to attach is too large.

As for the outer diameter of the ink reservoir tube D, the larger the outer diameter is, the more stored ink is. The range, however, of the outer diameter D of the ink reservoir tube, which allows the use of the ink reservoir tube without the feeling of any difference from the conventional writing tools, is favorably 3.6 mm or less.

As for the thickness t of the ink reservoir tube excluding the connecting portion 1*a* and 1*b*, the above-described range is preferable because, when the thickness t exceeds 0.56 mm, a sufficient ink amount is not available with the desired range of D of the outer diameter of the ink reservoir tube 1 and a problem of blurring occurs at high writing speed.

The mounting strength of the connecting portion of the barrel and the ink reservoir tube, that is, the mounting strength B of a refill mounting portion 25*b* of the slider 25 and the connecting portion 1*b* of the ink reservoir tube 1 is set 1.96 N or more or is set more preferably 4.9 N or more.

In contrast to this, the mounting strength of the connecting portion of the ink reservoir tube between the writing tip 2 or the relay member 3 holding a writing tip, that is, the mounting strength A between the writing tip 2 or the relay member 3 and the connecting portion 1*b* of the ink reservoir tube is set 9.8 N or more and is set to hold relation that A>B.

When the mounting strength A between the writing tip 2 or the relay member 3 and the connecting portion 1*b* of the ink reservoir tube is less than 9.8 N, the writing tip 2 may detach from the ink reservoir tube 1 at exchanging of a refill or may spontaneously fall with the lapse of time.

The mounting strength at the connecting portion is obtained by measuring the necessary force to extract the connecting portion using a commercially available push-pull gauge, such as Force Gauge manufactured by IMADA Co., Ltd.

According to the writing tool above described with reference to FIGS. 1A to 3, since the mounting strength A between the writing tip 2 or the relay member 3 and the connecting portion 1*b* of the ink reservoir tube is set higher than the mounting strength B of the slider 25 and the connecting portion of the ink reservoir tube 1, an un intended problem of leakage of ink can be prevented. This allows the extraction of the ink reservoir tube 1 from the slider 25 of the barrel surely and the replacement of refills smoothly.

For the refill according to the present invention, ink to be stored in the ink reservoir tube having the following characteristics can be used: for the aqueous ink whose solvent is water, the ink has a viscosity at 25° C. of 100 to 3000 mPa·s measured at a shear speed of 3.8/s and of 20 to 200 mPa·s measured at a shear speed of 383/s, and for the oil-based ink whose solvent is an organic solvent, the ink has a viscosity of 20000 mPa-s or less measured at a shear speed of 3.8/s and more favorably 3000 mPa·s.

Figure 4A:
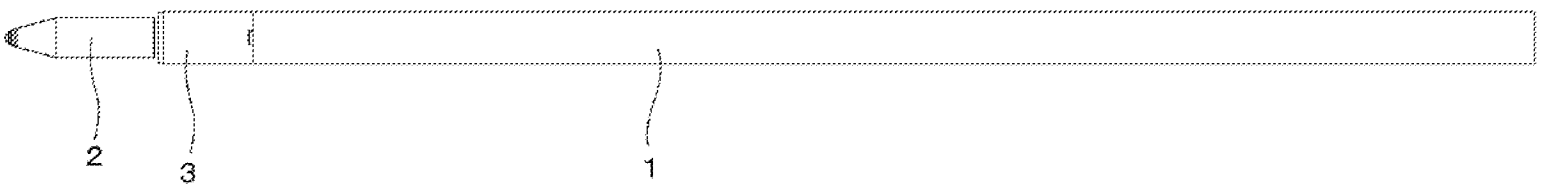
FIG. 4A is a front view, 4B is a central cross-sectional view, and 4C is an enlarged cross-sectional view of the main part, all of a second embodiment of a refill.
Figure 4B:
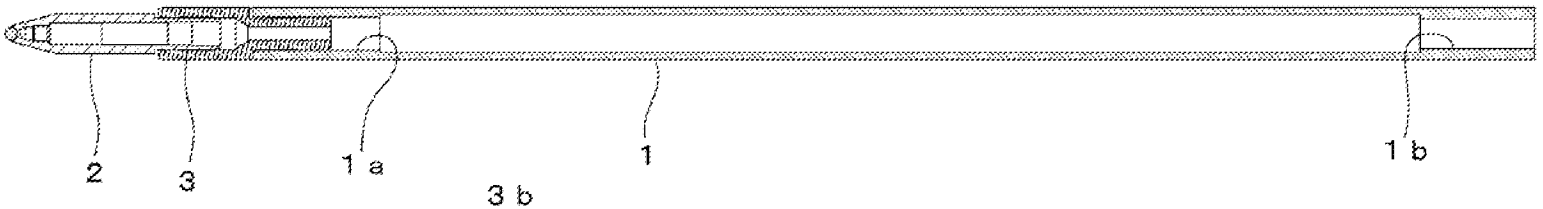
Figure 4C:
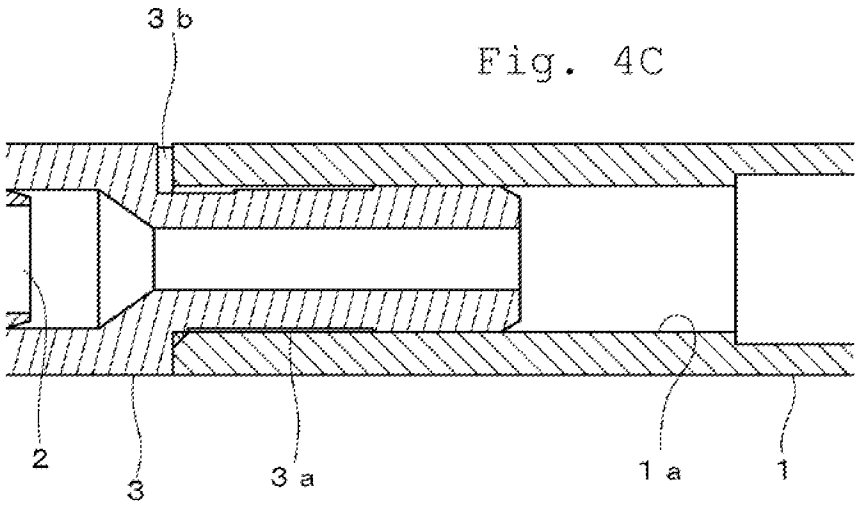

FIGS. 4A, 4B, and 4C show a second embodiment of a refill that is suitably used for a composite writing tool shown in FIGS. 1A, 1B and 2. An ink reservoir tube 1, writing tip 2, and a relay member 3 that form the refill are similarly constructed to those in the refill in the first embodiment shown in FIGS. 2 and 3.

The degree of press-fitting of the relay member 3 to the connecting portion having a thicker thickness at the front end of the ink reservoir tube 1 is set smaller compared to the writing tool described with reference to FIGS. 1 to 3 and an adhesive is intercalated between the relay member 3 and the connecting portion 1*a*.

As shown by the enlarged cross-sectional view of FIG. 4C, a slight gap indicated as an adhesive receiver 3*a* between the connecting portion having a thicker thickness of the ink reservoir tube 1 and the relay member 3 and the adhesive is kept in the adhesive receiver 3*a*.

An airflow passage 3*b* of a slightly larger gap communicating with the adhesive receiver 3*a* between the front end of the ink reservoir tube 1 and the relay member 3. The excess adhesive at the adhesive receiver 3*a* can be flown out through the airflow passage 3*b*.

By using a silicone-based adhesive as the adhesive, sufficient mounting strength between the ink reservoir 1 and the relay member 3 can be obtained and the deterioration of ink can be suppressed, even if the adhesive mixes into the ink in the ink reservoir tube 1. The deterioration of ink can be suppressed, even if the adhesive mixes into the ink in the ink reservoir tube 1.

The connecting portion 1*b* at the rear side of the ink reservoir tube 1, shown in FIGS. 4A, 4B, and 4C, is constructed similarly to the refill shown in FIG. 2; the connecting portion is attached to refill mounting portion 25*b* shown in FIG. 2, the connecting portion of the barrel. Thus, also in the case of refill of the second embodiment, the mounting strength of the connecting portion between the ink reservoir tube 1 and the ballpoint pen tip 2 can be ensured to be high. This can prevent the occurrence of a problem of leakage of ink, for example, at the time of replacement of refill.

Figure 5A:
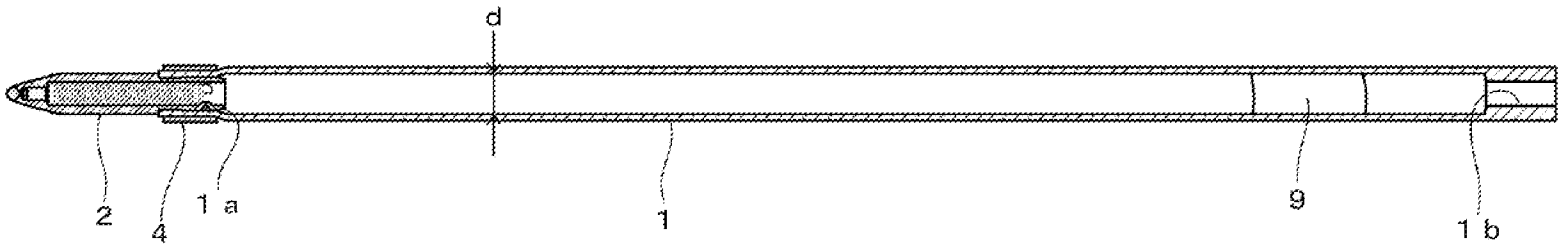
FIG. 5A is a central cross-sectional view, and 5B is an enlarged cross-sectional view of the main part, all of a third embodiment of a refill.
Figure 5B:
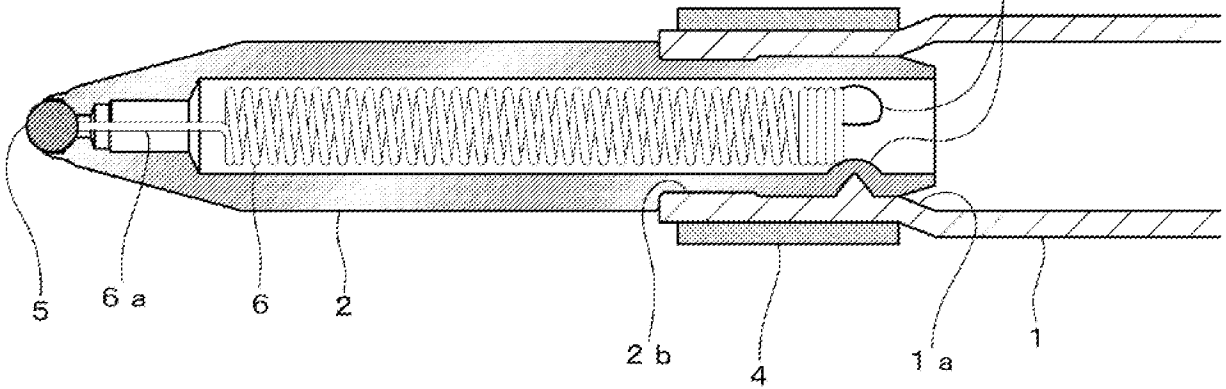

FIGS. 5A and 5B show a third embodiment of refill, which is suitable employed to composite writing tools shown in FIGS. 1A, 1B and 2. The refill shown in FIGS. 5A and 5B has a structure in which the connecting potion 1*a* is formed to have a slightly narrower outer diameter and inner diameter of the front end portion compared to those of the central area of the ink reservoir tube 1; a ballpoint pen tip 2 is attached to the connecting portion.

A touching portion from the inside, inscribed portion, of the ballpoint pen tip 2 to the ink reservoir tube 1 has a thinner outer diameter compared to the front end portion and a metal tube 4 is attached along the outer circumference of the ink reservoir tube at the connecting portion of the ink reservoir tube and the ballpoint pen tip 2.

As shown in FIG. 5B, a well-known writing ball 5 is mounted to the tip end of the ballpoint pen tip 2. In this embodiment, a spring 6 is mounted in an inner space of the ballpoint pen tip 2. The tip end of the spring is formed to be a straight rod to form a pushrod 6*a* and the pushrod 6*a* presses the writing ball 5 to the tip end direction.

Part of the rear end portion of the ballpoint pen tip 2 is crimped inward and the crimped portion 2*a* locks the rear end portion of the spring 6.

A stepped portion 2*b* to reduce the outer diameter is formed in the inscribed portion of the ballpoint pen tip 2 to the ink reservoir tube 1 adjacent to the crimped portion 2*a*. Part of the resin material forming the connecting portion 1*a* at the front end of the ink reservoir tube 1 invades into the crimped portion 2*a* and the stepped portion 2*b* of the ballpoint pen tip 2 by heat melting; whereby this increases the mounting strength of the connecting portion of the ballpoint pen tip 2 and the ink reservoir tube 1. The metal tube 4 has functions of heat melting of the connecting portion 1*a* at the front end of the ink reservoir tube 1 by electromagnetic induction heating and of keeping the mounting strength of the connecting portion of the ballpoint pen tip 2 and the front end of the ink reservoir tube 1.

An ink backflow preventing body (follower) 9 is provided in the ink reservoir tube of the refill shown in FIGS. 5A and 5B. The ink backflow preventing body 9 is disposed at a position being in contact with a rear face of the ink in the ink reservoir tube 1. The ink backflow preventing body goes forward along with consumption of ink while writing. A relation is desirably set such that $X/d^2>0.20$, where X (mg) denotes ink consumption per writing distance of 100 m and d (mm) denotes the inner diameter of ink reservoir tube.

The ink backflow preventing body 9 preferably has the following features: the ink backflow preventing body 9 contains one or more types of poly-α-olefin that are a synthesized oil having a viscosity of 200 mPa·s or more at 40° C., the total amount of the poly-α-olefin is 80 wt. % or more of the total composition, the viscosity ranges from 1000 mPa-s to 40,000 mPa·s at 23° C., the shear-thinning index is 0.95 or more at a shear rate of 1 to 10 l/s, and no shear-thinning viscosity-imparting agent is contained.

The poly-α-olefin stated here is a synthesized oil obtained by polymerization of α-olefin, and the typical α-olefin as a reaction starting material are 1-octene, 1-decene, 1-dodecene, and others. Mainly polymers of 1-decene are used in industries. Since the quality of α-olefin having less number of carbon atoms degrades when placed kept upward at a high temperature, the number of carbon atoms is preferably eight (8) or more, and more preferably, the α-olefin mainly contains 8 to 20 carbon atoms.

Poly-α-olefin is given below: Barrel Process Oil P-380, Barrel Process Oil P-1500, Barrel Process Oil P-2200, Barrel Process Oil P-10000, and Barrel Process Oil P-37500 (those manufactured by MATSUMURA OIL Co., Ltd), and ExxonMobil SHF-403, SHF-1003, SuperSyn 2150, SuperSyn 2300, SuperSyn 21000 and SuperSyn 23000 (those manufactured by Exxon Mobil Corporation), and others.

The ink backflow preventing body 9 has a filled length of 10 mm or more and the surface tension at 25° C. is preferably 32.0 mN/m or more.

When the conditions are satisfied, extremely outstanding characteristics of ink-following ability are obtained and the visibility of the residual amount of ink is ensured while the ink is consumed. That is, the ink backflow preventing body 9 can follow the consumption of ink by writing without a decrease of the volume due to sticking to the wall surface while moving.

In addition, since the ink can be reliably followed even if the ink consumption is large, stable ink discharging performance is ensured during writing.

The refill of the third embodiment shown in FIGS. 5A and 5B has a construction where a ballpoint pen tip 2 is directly attached to the front end of the ink reservoir tube 1. Another construction where a relay member 3 holding a ballpoint pen tip is attached to the front end of the ink reservoir tube 1 can achieve a similar effect.

The connecting portion 1*b* of the rear end of the ink reservoir tube 1 shown in FIGS. 5A and 53, similarly constructed to the refill shown in FIG. 2, is attached to the refill mounting member 25*b* of the connecting portion of the barrel, shown in FIG. 2.

Thus, in the case of the refill of the third embodiment shown in FIGS. 5A and 5B, the mounting strength of the connecting portion between the ink reservoir tube 1 and the ballpoint pen tip 2 can be ensured to be high. This can prevent the occurrence of a problem of leakage of ink, for example, at the time of replacement of refill.

FIGS. 6A, 6B, 7A and 7B show a fourth and fifth embodiment of refills suitably usable to composite writing tools shown in FIGS. 1A, 1B and 2.

An ink backflow preventing ball 7 that functions as a backflow preventing mechanism is housed in the relay member 3 holding a ballpoint pen tip 2 in the refills shown in FIGS. 5A, 6B, 7A and 7B.

The backflow preventing ball 7 acts to prevent the ink in the ink reservoir tube 1 not to retract by keeping in close contact to the tapered face of the axial hole formed in the relay member 3 due to the inflow of air from the tip end of the ballpoint pen tip 2 when the ballpoint pen tip 2 is stored kept upward.

Figure 6A:
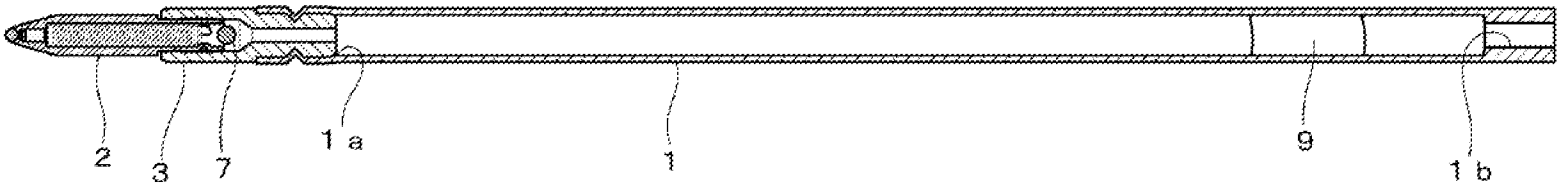
FIGS. 6A and 6B show a fourth embodiment of a refill, where 6A is a central cross-sectional view, and 6B is an enlarged cross-sectional view of the main part.
Figure 6B:
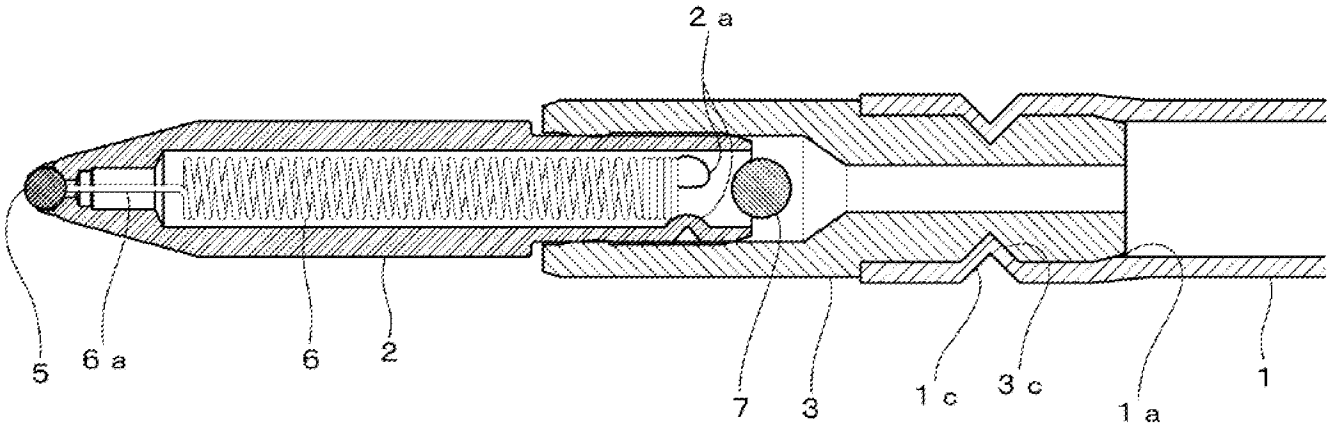

In a refill shown in FIGS. 6A and 6B, an annularly projecting locking protrusion 1*c* is formed on an inner surface of the ink reservoir tube 1 at the connecting portion of the relay member 3 holding the ballpoint pen tip 2 at one of the ink reservoir tube 1.

A locking recess 3*c* that fits the locking protrusion 1*c* is formed along the circumferential direction of the relay member 3 holding the ballpoint pen tip 2. A construction ensuring the mounting strength of the connecting portion is employed by combining the locking protrusion 1*c* and locking recess 3*c*; both are formed continuously along the circumferential surfaces.

Figure 7A:
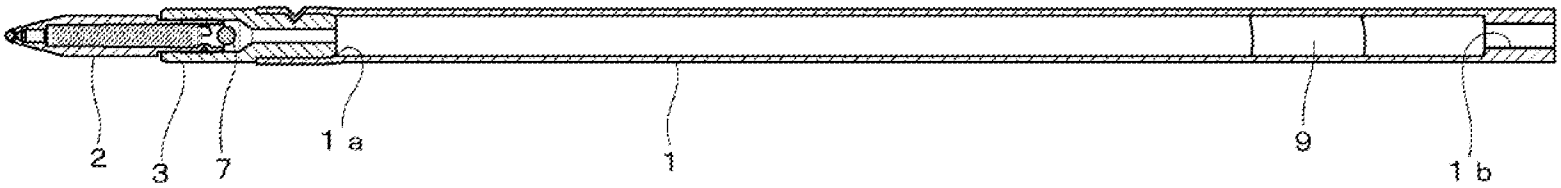
FIGS. 7A and 7B show a fifth embodiment of a refill, where 7A is a central cross-sectional view, and 7B is an enlarged cross-sectional view of the main part.
Figure 7B:
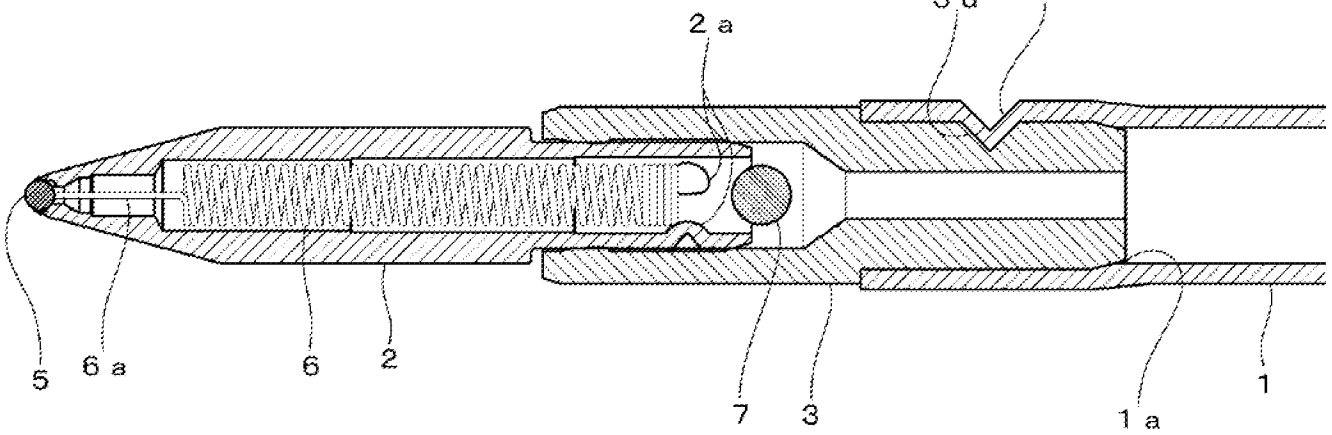

Meanwhile, in a refill shown in FIG. 7A, projecting locking protrusions 1*d* are formed in a stepping-stone-wise on an inner surface of the ink reservoir tube 1 at a connecting portion with the relay member 3 holding the ballpoint pen tip 2 at one end of the ink reservoir tube 1. A construction ensuring the mounting strength of the connecting portion is employed by combining the locking protrusion 1*c* and locking recess 3*c*; both are formed in a stepping-stone-wise along the circumferential surfaces.

For the refills shown in FIGS. 6A, 6B, 7A, and 7B, the ink reservoir tube 1 is preferably made of a metal material such as an aluminum alloy, and the relay member 3 is preferably made of a flexible resin material. Further, in the refill shown in FIGS. 6A and 6B, the locking protrusion 1*c* and the locking recess 3*c* can be continuously formed by performing caulking along the outer circumference of the ink reservoir tube 1 in a state where the relay member 3 is inserted to the front end of the ink reservoir tube 1.

In the refill shown in FIGS. 6A and 6B, the locking protrusion 1*d* and the locking recess 3*d* can be formed in a stepping-stone wise by caulking at three points, for example, using a tool such as a punch along the outer circumference of the ink reservoir tube 1 in a state where the relay member 3 is inserted to the front end of the ink reservoir tube 1. In the refills shown in FIGS. 6A, 6B, 7A, and 7B, the ink reservoir tube 1 and the relay member 3 are connected by the biting of the locking protrusions formed on the reservoir tube into the relay member 3 made of a flexible material.

The connecting portion 1*b* at the rear end of the ink reservoir tube shown in FIGS. 6A, 6B, 7A, and 7B is constructed similarly to the refill shown in FIG. 2, and the connecting portion 1*b* is attached to the refill mounting portion 25*b* that is a connecting portion of the barrel shown in FIG. 2. As for the refills of the fourth and fifth embodiment each shown in FIGS. 6A, 6B, 7A and 7B, the mounting strength at the connecting portion between the ink reservoir tube 1 and the ballpoint pen tip 2 can be surely increased, and the occurrence of a problem such as leakage of ink can be prevented at a time of replacement of refills.

Figure 8A:
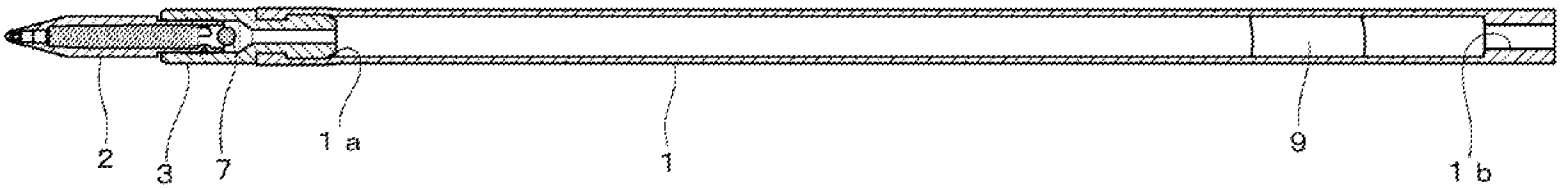
FIGS. 8A and 8B show a sixth embodiment of a refill, where 8A is a central cross-sectional view, and 8B is an enlarged cross-sectional view of the main part.
Figure 8B:
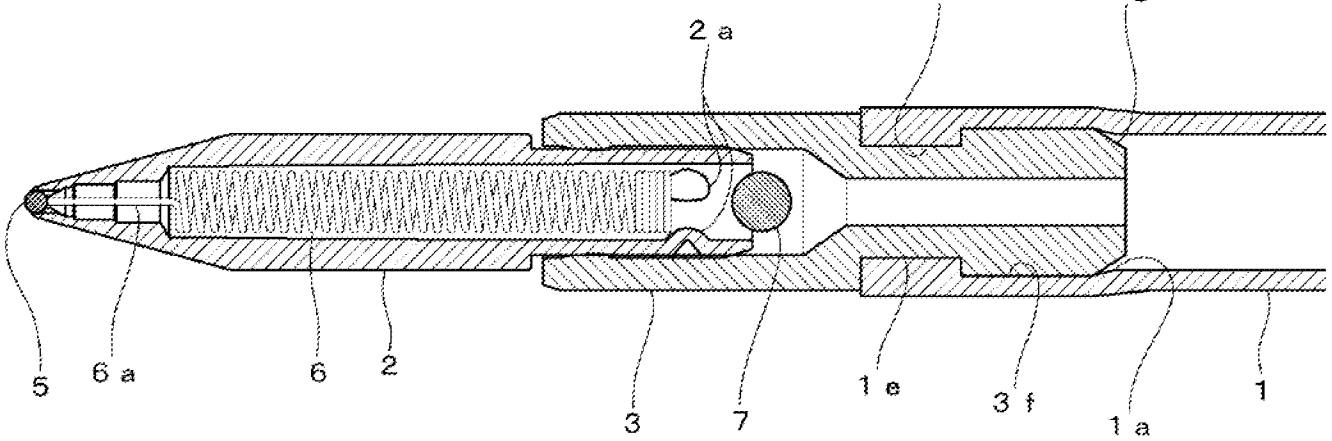

FIGS. 8A and 8B show a refill of a sixth embodiment which can be suitably employed in a composite writing tool shown in FIGS. 1A, 1B and 2.

The refill shown in FIGS. 8A and 8B employs a resin material such as polypropylene for the ink reservoir tube. A thickened portion toward the inner face of the ink reservoir tube is formed at the connecting portion of the relay member 3 holding a ballpoint pen tip at the front end of the ink reservoir tube 1.

In the connecting portion between the ink reservoir tube 1 and the rear portion of the relay member 3, a reduced-diameter portion 3*e* that has a diameter that is reduced compared to the outer diameter of the relay member is formed. Continuously from the reduced-diameter portion 3*e*, a cylindrical head part 3*f* having a slightly thicker diameter compared to the reduced-diameter portion 3*e* is formed toward the rear side, and a taper 3*g* is formed at the rear periphery by chamfering.

With this structure, by pressing the thickened portion 1*e* with the taper 3*g* toward the axial hole of the thickened portion 1*e* that is formed at the front end of the ink reservoir tube 1, the head part 3*f* climbs over the thickened portion 1*e* of the ink reservoir tube 1 with expanding the taper 3*g* of the relay member 3. Then the thickened portion 1*e* becomes engaged in the reduced-diameter portion 3*e* of the relay member 3 and the relay member 3 is connected with the front end of the ink reservoir tube 1 as shown in FIGS. 8A and 8B.

The connecting portion 2*b* at the rear end of the ink reservoir tube shown in FIGS. 8A and 8B is constructed similarly to the refill shown in FIG. 2, and the connecting portion 1*b* is attached to the refill mounting portion 25*b* that is a connecting portion of the barrel shown in FIG. 2. As for the refills of the sixth embodiment shown in FIGS. 6A and 8B, the mounting strength at the connecting portion between the ink reservoir tube 1 and the ballpoint pen tip 2 can be surely increased, and the occurrence of a problem such as leakage of ink can be prevented.

Figure 9A:
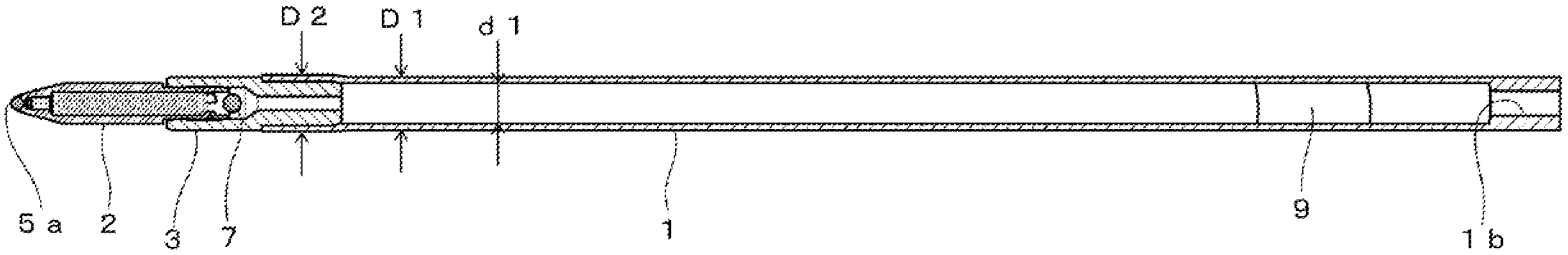
FIGS. 9A, 9B, and 9C show a refills to be combined, where
Figure 9B:
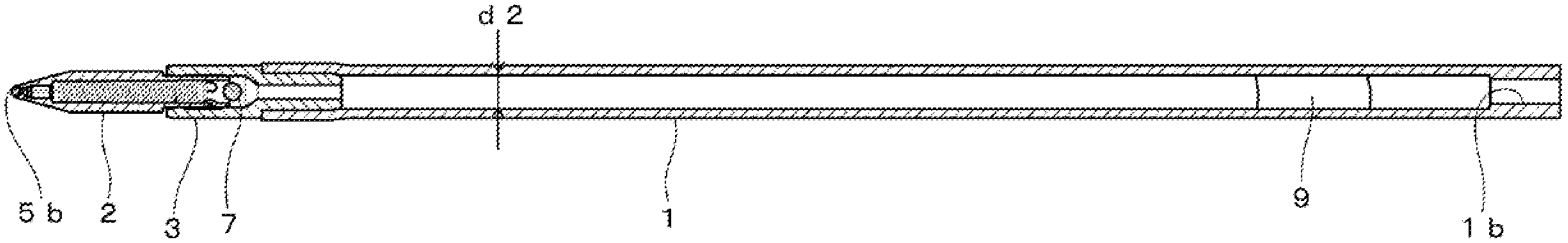
Figure 9C:
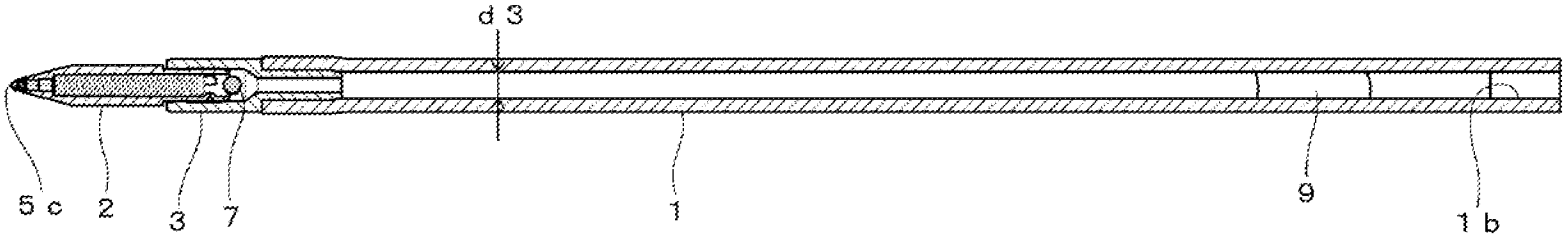

FIGS. 9A, 9B, and 9C show a refill of a sixth embodiment which can be suitably employed in a composite writing tool shown in FIGS. 1A, 1B and 2.

As for the three refills shown in FIGS. 9A through 9C, writing balls 5*a*, 5*b*, and 5*c* provided in the respective writing tip 2 have different ball diameters. The ball diameter of the writing ball 5*a*, 5*b*, and 5*c* is 0.7 mm, 0.5 mm, and 0.28 mm, respectively; the writing tip 2 is used that has a ball of different diameter set corresponding to the different ink flow amount.

Further, the inner diameters of the ink reservoir tubes used in the three refills shown in rigs. 9A through 9C are different; the inner diameter is in a relationship that d1>d2>d3, as shown in FIGS. 9A, 9B, and 9C. That is, the decrease of ink along the length direction of the ink reservoir tube per the same writing distance is set to be approximately the same.

The outer diameter D1 of the three refills along the length direction at the central part of the ink reservoir tubes shown in FIGS. 9A through 9C are made to have the same size, and the diameter of the connecting portion D2 is expanded by 0.1 mm from the outer diameter D1 due to connection by press-insert ion of the relay member 3 at each front portion of the ink reservoir tube 1. This enables the obtainment of a predetermined mounting strength at the connecting portion of the ink reservoir tube 1 and the ballpoint pen tip 2.

The outer and inner diameters of the rear connecting portion of the respective ink reservoir tubes shown in FIGS. 9A, 9B, and 9C are set to be the same, and are constructed similarly to the refill shown in FIG. 2. Each of the rear connecting portions is attached to the refill mounting portion 25*b*, the connecting portion of the barrel, shown in FIG. 2. Thus, as for the refills of the seventh embodiment to ninth embodiment shown in FIGS. 9A, 9B, and 9C, the mounting strength at the connecting portion between the ink reservoir tube 1 and the ballpoint pen tip 2 can be surely increased, and the occurrence of a problem such as leakage of ink can be prevented.

To identify the three different refills shown in FIGS. 9A, 9B, and 9C, in the composite writing tool shown in FIG. 2, the refill advancing operating member 25*a* of the sliders 25 to which the respective refills are attached are made to preferably have different appearances.

One method of identification is achieved by varying the depth of chromatic or achromatic coloring to the respective refill advancing operating members 25*a*. Another identification method is varying the roughness of the material of the refill advancing operating members. Still another identification method is changing the appearances of the respective refill advancing operating members 25*a*, and further, a combination of the above methods can be used to identify the refill advancing operating members.

FIGS. 10A, 10B, 11A, and 11B show a tenth embodiment of refill suitably usable to a composite writing tool shown FIGS. 1A, 1B and 2. On a refill shown in the embodiment, a plurality (two lines in the drawing) of annular locking portions 11 are formed along an axial direction on the connecting portion 3*h* made on the relay member 3 with the ink reservoir tube 1. Each of the annular locking portions 11 has a tapered face 11*a* whose diameter increases toward the ballpoint pen tip 2 and a falling section 11*b* continuing from the tapered face whose diameter sharply reduces. The outer diameters of the annular locking portions having the tapered face 11*a* and the falling section 11*b* are formed to increase toward the tip end of a ballpoint pen tip 2.

By the use of the annular locking portion 11 shown in the tenth embodiment, the ink reservoir tube 1 and the relay member 3 are connected by pressingly inserting the front end of the ink reservoir tube 1 made of a resin material such as polypropylene toward the tapered face 11*a* formed on the annular locking portion 11, so that the opening at the front end of the ink reservoir tube 1 is expanded by the tapered face 11*a* and thereby the connecting portion 3*h* is covered.

Figure 10A:
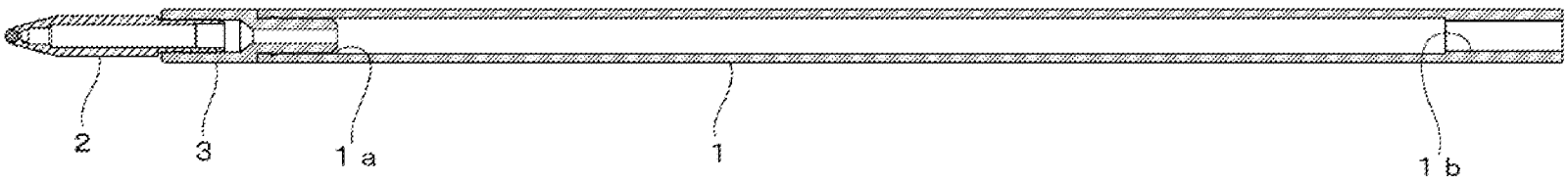
FIGS. 10A and 10B show a tenth embodiment, where 10A is a central cross-sectional view
Figure 10B:
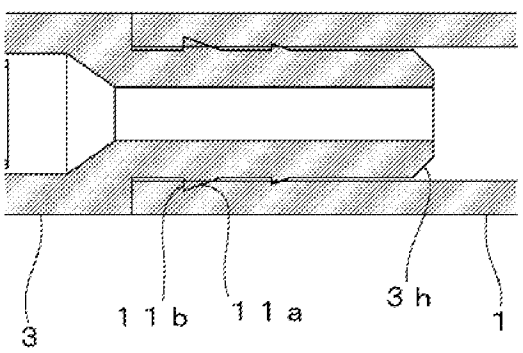
Figure 11A:
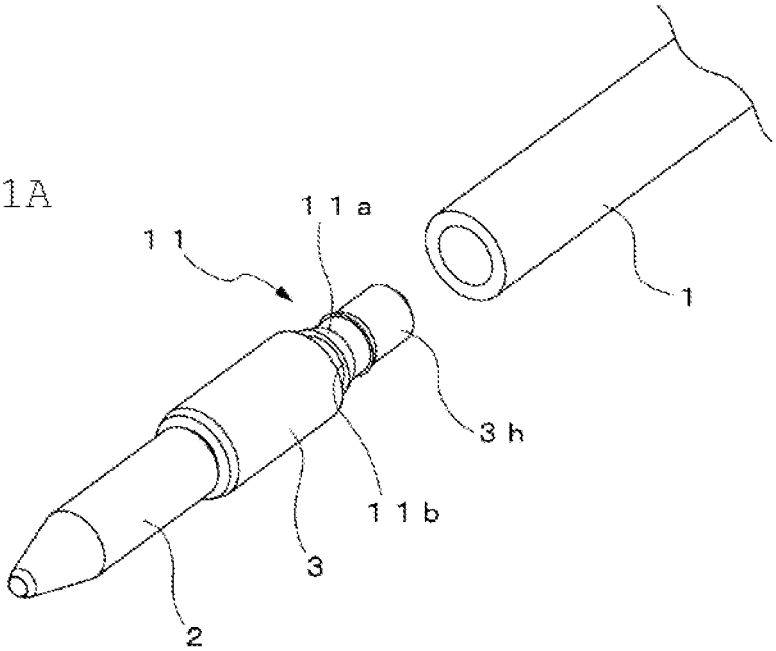
FIGS. 11A and 11B show an external configuration in which the writing chip and the ink reservoir tube are separated from each other of a refill shown in FIGS. 11A and 11B, where
Figure 11B:
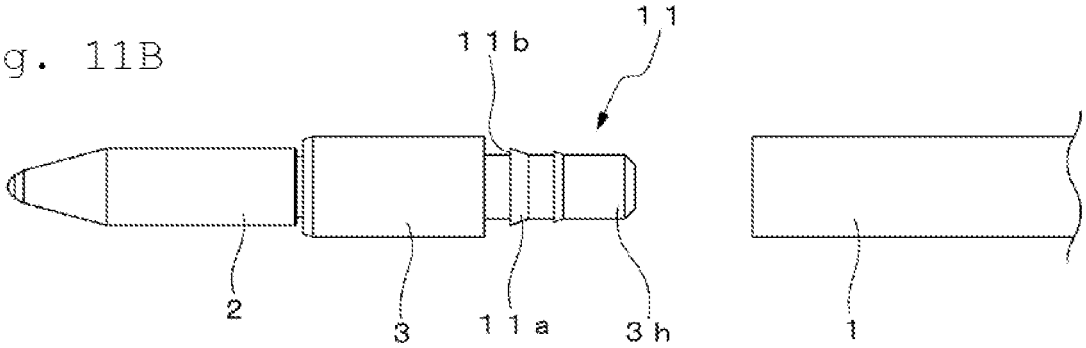

As shown in FIG. 10B in a state where the front end of the ink reservoir tube 1 and the connecting portion 3*h* are connected, the falling section 11*b*, whose diameter sharply reduces, formed on the annular locking portion 11 acts like a barb of a hook to effectively prevent the ink reservoir tube 1 from detaching from the connecting portion 3*h*.

In the tenth embodiment, annular locking portion 11, composed of the tapered face 11*a* and the falling section 11*b*, has two rows along the axial direction but may have three rows or more if necessary.

The connecting portion 1*b* at the rear end of the ink reservoir tube 1, as shown in FIG. 10A, has a construction similar to the refill shown in FIG. 2 and is mounted on the refill mounting member 25*b*, shown in FIG. 2, a connecting portion of the barrel.

Therefore, as for the refills of the tenth embodiment, the mounting strength at the connecting portion between the ink reservoir tube 1 and the connecting member for the ballpoint pen tip 2 can be surely increased, and the occurrence of a problem such as leakage of ink can be prevented.

Figure 12A:
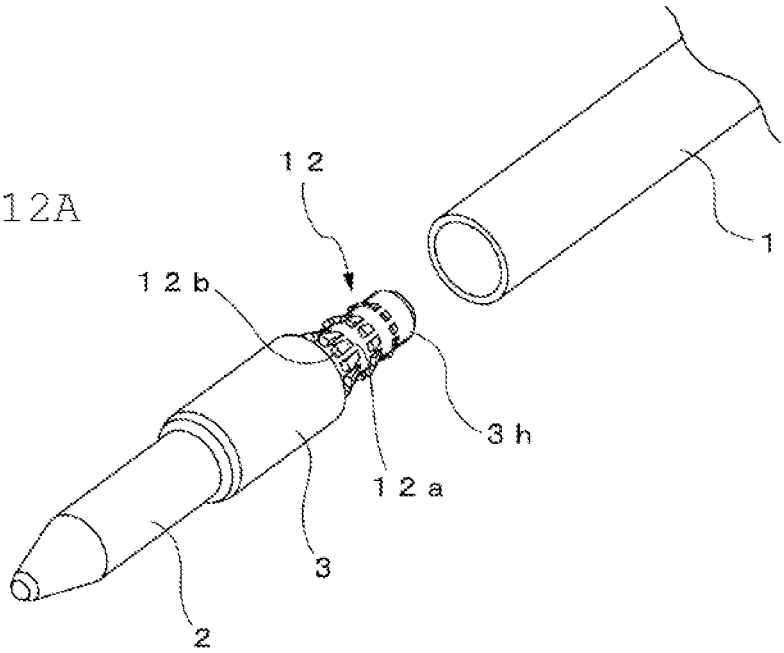
FIGS. 12A and 12B show an external configuration in which the writing chip and the ink reservoir tube are separated from each other in the eleventh embodiment of a refill, where
Figure 12B:
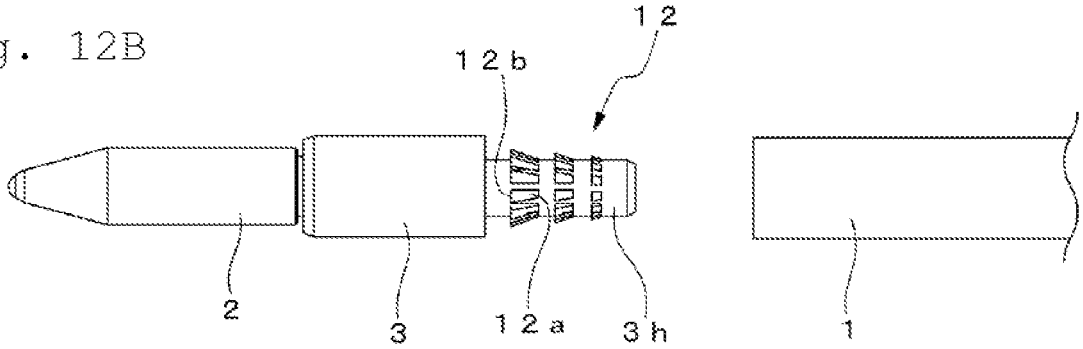

FIGS. 12A and 12B show an eleventh embodiment of a refill suitably applicable to a composite writing tool, for example, shown in FIGS. 1A, 1B, and 2. In the refill shown in this embodiment, the locking means is provided by forming a plurality of protrusions 12 discontinuously along the circumferential and axial directions on the mounting portion 3*h* of the ink reservoir tube 1 formed on the relay member 3.

Each protrusion has a gradually rising tapered face 12*a* and a falling section 11*b* continuing from the tapered face 12*a*. The height of each protrusion 13 is set taller toward the tip end of the ballpoint pen tip 2.

Namely, the protrusions 12 are formed by dividing the annular locking portions 11 having tapered faces 11*a* and falling sections 11*b* shown in FIGS. 10A, 10B, 11A, and 11B with a plurality of slits along the axial direction.

A plurality of protrusions 12 respectively provided with a tapered face 12*a* and a falling section 11*b* is disposed also in a locking portion shown in the eleventh embodiment, and the ink reservoir tube is relatively easily mounted to the connecting portion 3*h* by pushing the front end of the ink reservoir tube 1, made of a resin material, such as polypropylene, toward the tapered face 12*a*. In a state where the ink reservoir tube 1 is mounted on the connecting portion 3*h*, the action of falling section 12*b* can prevent detachment of the ink reservoir tube 1 from the connecting portion 3*h* similarly to the embodiments shown in FIGS. 10A, 10B, 11A, and Although not shown in FIGS. 12A and 12B, the connecting portion at the rear end of the ink reservoir tube 1 has a similar construction to the connecting portion 1*b* of the refill shown in FIG. 2 and is mounted on the refill mounting portion 25*b*, shown in FIG. 2, which is the connecting portion at the barrel side.

As for the refills of the eleventh embodiment shown in FIGS. 12A and 12B, the mounting strength at the connecting portion between the ink reservoir tube 1 and the connecting member of the ballpoint pen tip 2 can be surely increased, and the occurrence of a problem such as leakage of ink can be prevented.

Figure 13A:
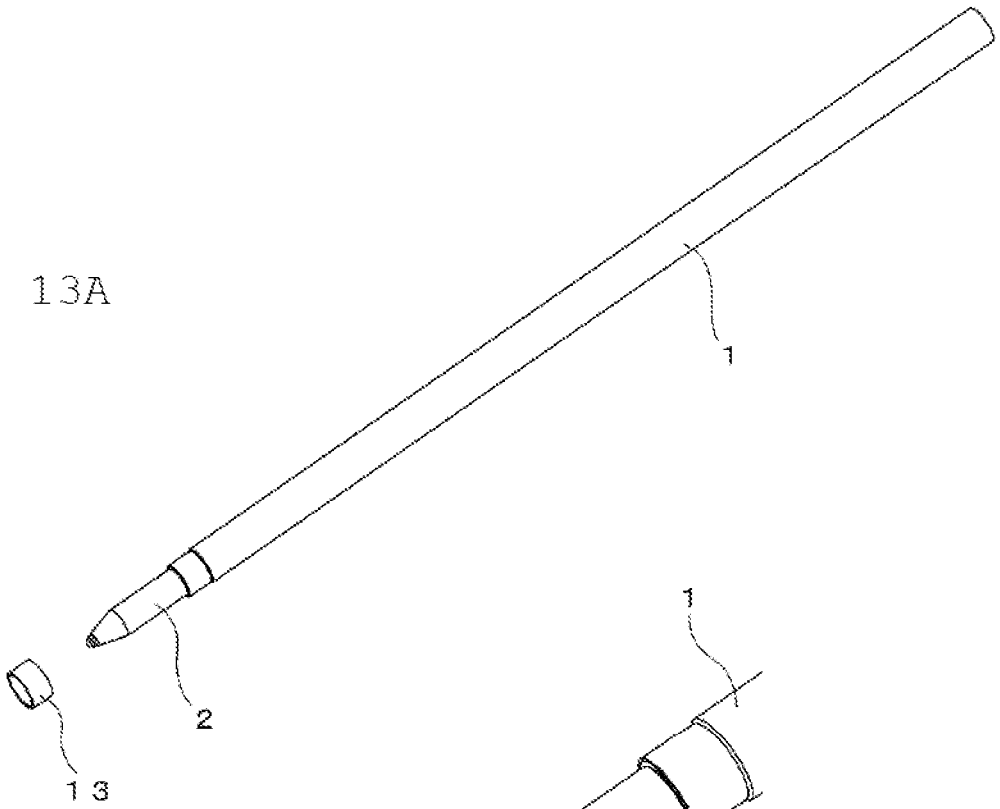
FIGS. 13A, 13B, and 13C show a twelfth embodiment of a refill, where
Figure 13B:
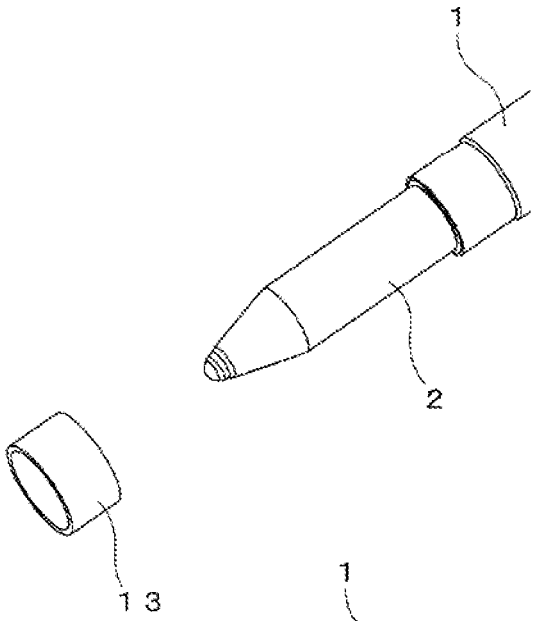
Figure 13C:
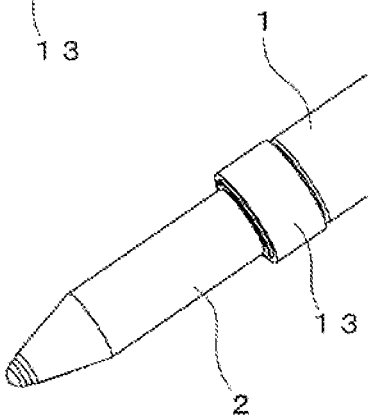

FIGS. 13A, 13B and 13C show a twelfth embodiment of a refill suitably applicable to such as a composite writing tool shown in FIGS. 1A, 1B and 2. In the refill shown in the embodiment, the ink reservoir tube 1 made of a resin material, such as polypropylene, is attached to the rear end of the ballpoint pen tip 2.

Further, a reinforcing member 13 shaped into a ring is inserted along the outer periphery of the ink reservoir tube 1 connected with the ballpoint pen tip 2.

The reinforcing member 13 is mounted from the tip end side of the ballpoint pen tip 2 as shown in FIGS. 13A, 13B and 13C such that the reinforcing member crimps the front end of the ink reservoir tube along the outer circumference of the ink reservoir tube 1; this achieves a secure connection between the ink reservoir tube 1 and the ballpoint pen tip 2.

Figure 14A:
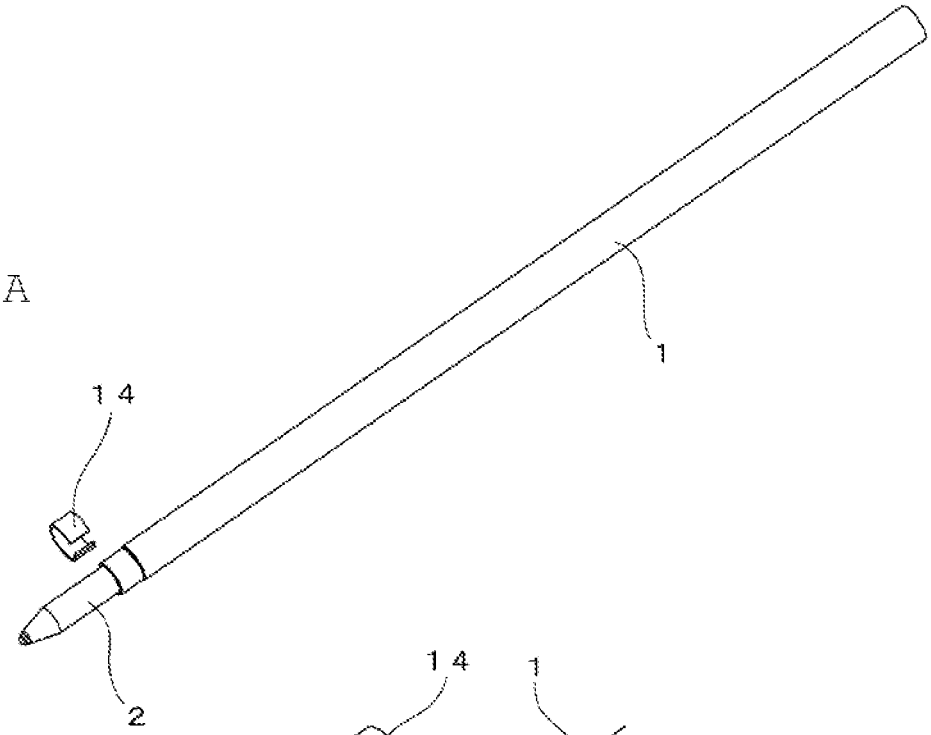
FIGS. 14A, 14B, and 14C show a thirteenth embodiment of a refill, where
Figure 14B:
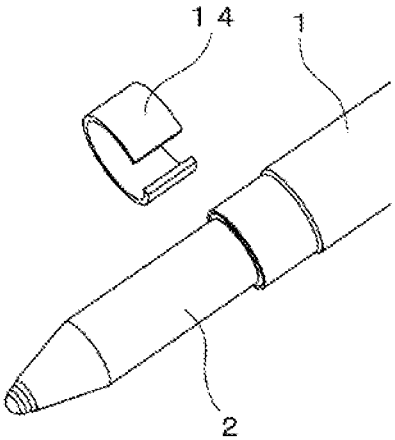
Figure 14C:
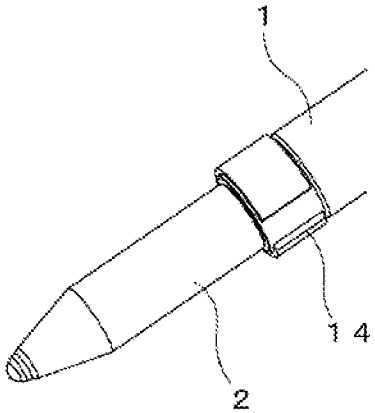

FIGS. 14A, 14B, and 14C show a thirteenth embodiment of a refill suitably applicable to such as a composite writing tool shown in FIGS. 1A, 1B, and 2. In the refill shown in the embodiment, similarly to the embodiment in FIGS. 13A, 13B and 13C, the ink reservoir tube 1 made of a resin material, such as polypropylene, is attached to the rear end of the ballpoint pen tip 2.

A reinforcing member 14 having a C-letter shape of the cross-section in the direction perpendicular to the axis is fitted to a connecting portion along the outer circumference of the ink reservoir tube 1 connected to the ballpoint pen tip 2.

The reinforcing member 14 is mounted from the tip end side of the ballpoint pen tip 2 such that the reinforcing member crimps the front end of the ink reservoir tube along the outer circumference of the ink reservoir tube 1. Since the reinforcing member 14 is formed to have a C-letter shape of the cross-section in the direction perpendicular to the axis and has a spring characteristic that reduces the diameter, the connection of the ink reservoir tube 1 with the ballpoint pen tip 2 is surely achieved.

Although not shown in Pics. 13A, 13B, 13C, 14A, 14B, and 14C, the connecting portion at the rear end of the ink reservoir tube 1 is constructed similarly to the connecting portion of the refill 1*b* shown in FIG. 2 and is mounted to the refill mounting portion 25*b* shown in FIG. 2, which is the connecting portion of the barrel.

As for the refills of the eleventh and twelfth embodiment shown in FIGS. 12A, 12B, 13A, 13E, and 13C, the mounting strength at the connecting portion between the ink reservoir tube 1 and the connecting member for the ballpoint pen tip 2 can be surely increased, and the occurrence of a problem such as leakage of ink at the replacement of refills can be prevented.

FIGS. 15A, 15B, 16A, and 16B show a fourteenth embodiment of a refill suitably applicable to such as a composite writing tool shown in FIGS. 1A, 1B and 2.

In the refill shown in the embodiment, a relay member 3 holding a writing tip 2 and a cylindrical body 3*i*, to which a front end of the ink reservoir tube 1 made of a resin material, such as polypropylene, is inserted are integrally formed. A garter spring (circular spring) 11 and a pressing ring 12 form a fitting means for the ink reservoir tube 1; the garter spring 11 is housed in the bottom of the cylindrical body and crimps the tip end of the ink reservoir tube 1, and the pressing ring is mounted in the cylindrical body 3*i* to position the garter spring in the bottom of the cylindrical body 3*i*.

The garter spring is a coil spring that is connected at each end to create a circular shape. The diameter of one end of the coil spring is formed gradually reducing toward the tip end and the coil spring can be circularly connected by inserting the diameter-reduced end into the other end of the coil spring.

In this embodiment, the inner diameter of the garter spring 11 is formed smaller than the outer diameter of the tip end of the ink reservoir tube 1. The garter spring 11 is housed in the bottom of the cylindrical body 3*i* formed in the relay member 3 and further and is placed in the bottom by the pressing ring 12 inserted in the cylindrical body 3*i*.

Figure 16A:
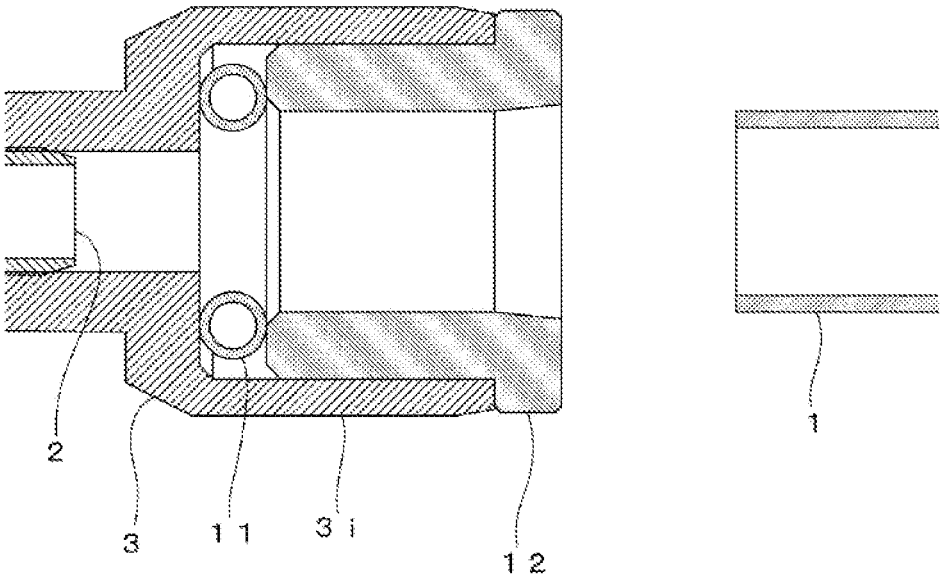
FIGS. 16A and 16B show the refill shown in FIGS. 15A and 15B, where 16A is an enlarged cross-sectional view of a main part in a state where the writing chip and the ink reservoir tube are separated from each other and 16B an enlarged cross-sectional view of a main part in a state where the ink reservoir tube is attached to the writing tip.
Figure 16B:
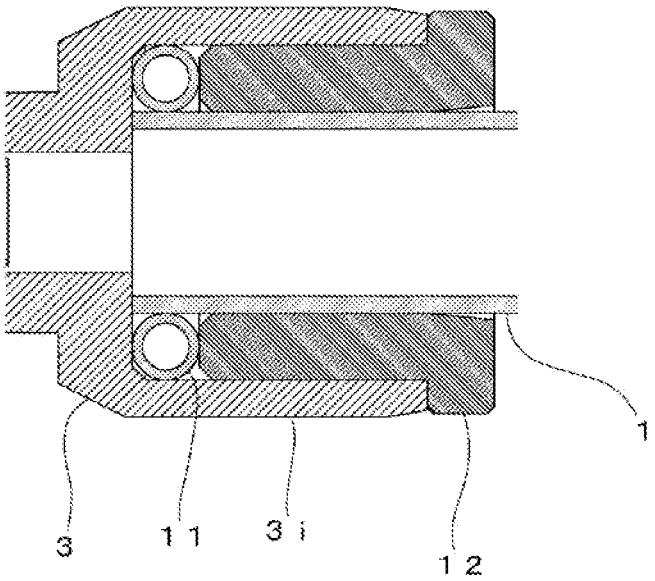

By inserting the tip end of the ink reservoir tube 1 to the opening of the pressing ring 12, the garter spring 11 is expanded by the tip end of the ink reservoir tube 1 and the garter spring 11 can grasp the tip end of the ink reservoir tube 1 as shown in FIG. 16B.

Further, since the garter spring 11 is held in the bottom of the cylindrical body 3*i* formed in the relay member 3 by the pressing ring 12, the ink reservoir tube 1 is kept being connected with the relay member 3 through the garter spring 11. Therefore, fitting action with high durability due to the garter spring 11 can be achieved.

Figure 15A:
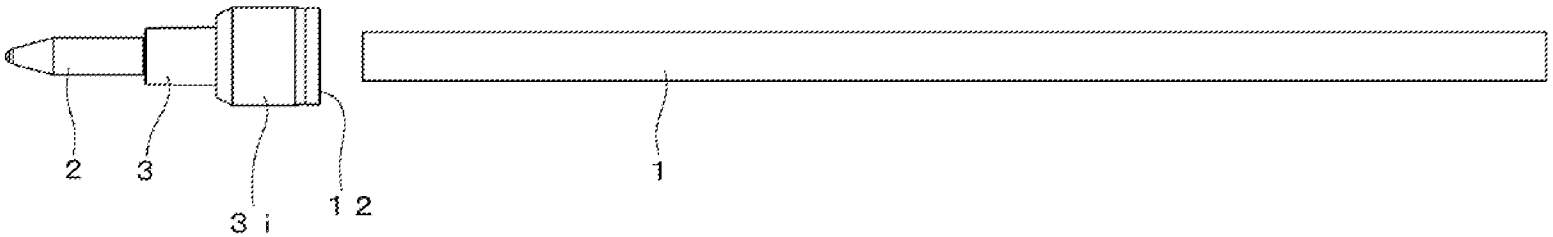
FIGS. 15A and 15B show an external configuration in which the writing chip and the ink reservoir tube are separated from each other in the fourteenth embodiment of a refill, where
Figure 15B:
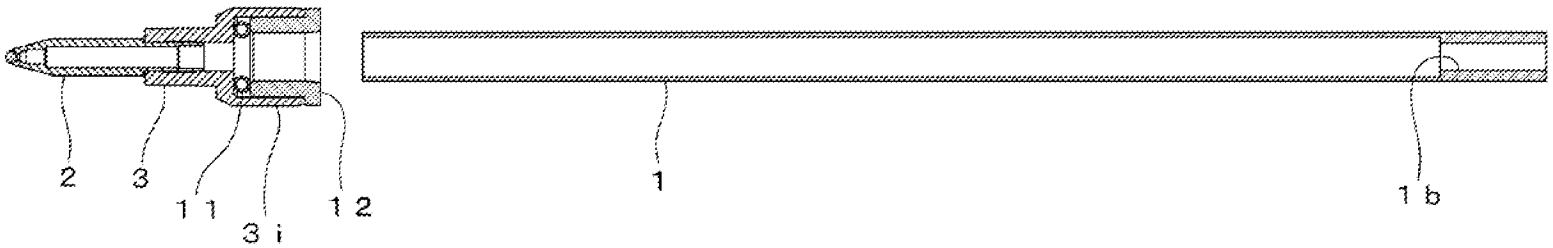

The connecting portion 1*b* at the rear end of the ink reservoir tube shown in FIGS. 15A and 15B has a construction similar to the refill shown in FIG. 2, and the connecting portion 1*b* is attached to the refill mounting portion 25*b* that is a connecting portion at the barrel shown in FIG. 2. As for the refills of the fourteenth embodiment each shown in FIGS. 15A and 15B, the mounting strength of the connecting portion between the ink reservoir tube 1 and the ballpoint pen tip 2 can be surely increased, and the occurrence of a problem such as leakage of ink can be prevented at a time of replacement of refills.

As for the refills described above, the embodiments shown in FIGS. 1A to 4C, 6A to 12B, and ISA to 16B show a state where the tip end of the ink reservoir tube 1 is connected with the connecting portion formed in the relay member 3 holding the writing tip 2. In contrast, the tip end of the ink reservoir tube 1 can be directly connected with the ballpoint pen tip 2.

Further, the embodiments shown in FIGS. 5A, 5B and 13A to 14C show a state where the tip end of the ink reservoir tube 1 can be directly connected with the ballpoint pen tip 2, but the tip end of the ink reservoir tube 1 can be connected with the connecting portion formed in the relay member 3 holding the ballpoint pen tip 2.

As cleared by the description above, with the writing tools provided with a refill according to the present invention, the action and effect described above can be achieved that the occurrence of a problem such as leakage of ink can be prevented at a time of replacement of refills and replacement of refills is smoothly performed.

Though embodiments using a ballpoint pen refill are shown in the above description, the present invention is also applicable to writing tools having refills provided with writing tips other than a ballpoint pen tip and, the similar action and effect described above can be achieved.

LIST OF REFERENTIAL NUMERALS

1 ink reservoir tube
1*a* front connecting portion
1*b* rear connecting portion
1*c* locking protrusion
1*d* locking protrusion
1*e* thickened portion
2 writing tip (ballpoint pen tip)
2*a* crimped portion
2*b* stepped portion
3 relay member
3*a* adhesive receiver
3*b* airflow passage
3*c* locking recess
3*d* locking recess
3*e* reduced-diameter portion
3*f* head part
3*g* taper
3*h*
3*i* cylindrical body
4 metal tube
5 writing ball
5*a*5*c* writing ball
6 spring
6*a* pushrod
7 backflow preventing ball
9 ink backflow preventing body (follower)
10 garter spring
11 locking portion
11*a* tapered face
11*b* falling section
12 pressing ring
21 front barrel
21*a* male thread
22 rear barrel
22*a* female thread
23 end opening
24 guiding slit
25 slider
25*a* refill advancing operating member
25*b* refill mounting member
25*c* rear locking portion
25*d* lock-releasing cam
27 inner cylinder
27*a* locking face
28 clip
28*a* ball portion
29 cap
29*a* mounting portion
30 shaft
31 coil spring
32 return spring

What is claimed is:

1. A writing tool, comprising:

a refill, comprising:

an ink reservoir tube having a straight cylinder shape whose wall thickness is less than 0.56 mm;

a first connection portion at which a writing tip or a relay member holding the writing tip attached to a first end of the ink reservoir tube;

a barrel;

a second connecting portion at which the refill is detachably attached to the barrel;

a cylinder formed in the writing tip or the relay member and the cylinder to which a front end portion of the ink reservoir tube is inserted;

a garter spring housed in a bottom portion of the cylinder and pressure-fitted to the tip portion of the ink reservoir tube; and a pressing ring housed in the cylinder to position the garter spring at the bottom portion of the cylinder, wherein the ink reservoir tube is joined to the writing tip or the relay member by the garter spring, and a mounting strength of the refill between the writing tip or the relay member holding the writing tip and the ink reservoir tube is set higher than a mounting strength between the barrel and the second connecting portion of the ink reservoir tube.

* * * * *